US006464598B1

(12) United States Patent
Miller

(10) Patent No.: US 6,464,598 B1
(45) Date of Patent: Oct. 15, 2002

(54) GOLF CLUB FOR CHIPPING AND PUTTING

(76) Inventor: Dale D. Miller, 1820 Ridgemill Ter., Dacula, GA (US) 30019

( * ) Notice: Subject to any disclaimer, the term of this patent is extended or adjusted under 35 U.S.C. 154(b) by 6 days.

(21) Appl. No.: 09/651,692

(22) Filed: Aug. 30, 2000

(51) Int. Cl.[7] ..... A63B 53/04

(52) U.S. Cl. ..... 473/314; 473/325; 473/328; 473/340

(58) Field of Search ..... 473/325, 245, 473/246, 247, 313, 324, 340, 341, 328, 314; D21/736

(56) References Cited

U.S. PATENT DOCUMENTS

| | | | | | |
|---|---|---|---|---|---|
| 2,491,383 | A | | 12/1949 | Liolich | 273/77 |
| 3,333,854 | A | * | 8/1967 | White | |
| 4,240,631 | A | * | 12/1980 | MacDougall | |
| 4,260,157 | A | * | 4/1981 | Jones | |
| D285,956 | S | | 9/1986 | Shearer | D21/220 |
| 5,044,637 | A | | 9/1991 | Wilson | 273/164 |
| 5,564,991 | A | * | 10/1996 | Hirose | |
| D378,113 | S | | 2/1997 | Rollinson et al. | D21/217 |
| 5,616,089 | A | | 4/1997 | Miller | 473/409 |
| 5,624,329 | A | | 4/1997 | Schneebeli | 473/287 |
| 5,749,793 | A | * | 5/1998 | Lucetti | |
| D399,911 | S | | 10/1998 | Nicolette et al. | D21/736 |
| D405,137 | S | | 2/1999 | Nelson | D21/738 |
| 6,045,453 | A | * | 4/2000 | Jenkins | |
| 6,203,446 | B1 | * | 3/2001 | Collins | |

* cited by examiner

*Primary Examiner*—Stephen Blau
(74) *Attorney, Agent, or Firm*—Andrus, Sceales, Starke & Sawall, LLP

(57) ABSTRACT

A golf club has a club head with a wedge face, a rounded sole, and a putting face located along a blade area between the wedge face and a front portion of the rounded sole. The putting face is located at a height above the crown of the rounded sole so that the putting face strikes a golf ball above the equator of the ball to impart top spin when putting. The wedge face preferably has a 90° loft. The club can be used for short chips by placing the hands forward of the club head to "de-loft" the wedge face, and chipping in an otherwise conventional manner. Also, the wedge face can be closed in order to hit high lob shots. A leading apex on the club head located at the intersection of the wedge face, the rounded sole, the toe of the club head, and the putting face points forward when the wedge face is closed to hit a high lob shot. The grooves on the wedge face are aligned to impart backspin when the wedge face is closed so that the leading apex is facing towards the target. The sole of the club head near the leading apex is designed to allow the leading apex to dig easily into the ground or sand without digging too deeply to create a chunk shot.

15 Claims, 2 Drawing Sheets

GOLF CLUB FOR CHIPPING AND PUTTING

BACKGROUND OF THE INVENTION

Many golfers would like to improve their chipping, pitching and putting, and especially pitching and chipping from bad lies. When a golfer finds his ball off the green in the fringe cut, in the rough, or in the sand trap within 50 yards of the hole, most golfers have a difficult time getting the ball into the hole without making at least three or more strokes. Additionally, striking the ball consistently is particularly difficult when the ball is in a bad lie. Many types of golf clubs called wedges have been created in an attempt to improve the golfer's ability to get the ball into the hole with fewer strokes when the ball is within 50 yards or so of the hole. However, with current wedges, golfers often unintentionally blade the ball. When using a swing effort required for a cleanly struck shot, blading propels the ball far beyond the hole. In other words, the golfer strikes the ball with the blade of the club head located between the wedge face and the front portion of the sole of the club head. Also, using approximately the same swing effort, many golfers often chunk the ball. In this case, rather than blading the ball, the golfer swings lower and causes the leading edge of the wedge to dig into the ground before impacting the ball, thus resulting in the shot ending up far short of the hole.

Many golfers also have difficulty making accurate shots from sand traps around the green. Normally, the problem with these shots is that the golfer takes too little or too much sand when the golfer swings to strike the ball. Sometimes, depending on the sand conditions, the sole of the wedge may actually bounce off of the sand before striking the ball, again causing a poor shot.

Yet another difficult shot for most golfers is attempting to putt when the ball is adjacent to or on the fringe around the green, or putting or chipping when the ball is near or in the rough around the green. Quite often, it is difficult to strike the ball cleanly with a putter, yet using a wedge under these conditions often proves to be too delicate of a shot for most golfers.

SUMMARY OF THE INVENTION

The invention is a versatile golf club which in its preferred embodiment can be used both for putting and hitting relatively short wedge shots. The golf club can be described as a putting wedge. Preferably, the golf club comprises a club head which comprises a hosel that is connected to the bottom of a club shaft, a wedge face, a sole, and a putting face located along a blade area between the wedge face and a front portion of the sole. The putting face has substantially a 0° loft relative to the shaft, and the wedge face has a loft relative to the shaft greater than 70°, and preferably substantially about 90° (although the loft may be somewhat greater than 90°).

The putting wedge allows the golfer to intentionally and consistently "blade" the ball with the putting face during the stroke. This controlled blading of the ball moves the ball within the distance intended by the golfer subject only to the resistance of the grass or other earth surface over which the ball will roll or hop. The golfer may also use the putting wedge to putt the ball when the ball is on the green. In the preferred embodiment of the invention, the putting face strikes the golf ball at or slightly above the equator of the golf ball. This type of impact with the golf ball facilitates top spin, and therefore energy transfer to the ball is relatively pure. The top spin helps the ball roll consistently because it reduces the initial skid of the golf ball which is typical when the putt is struck underneath the equator of the ball. With top spin after impact, the putting wedge is able to improve distance, control, and accuracy on the line intended by the golfer. The sole of the golf club is rounded, and a crown on the rounded sole is intended to slide easily along the surface of the green (or other surface) during the part of the putting stroke in which the putting face impacts the ball. This further improves consistency.

The golfer can also use the club on short chips by "de-lofting" the wedge face, which is accomplished by holding their hands forward of their normal position (see FIG. 5) and taking the chip shot. The wedge face will loft the ball at a steep angle. The rounded sole adjacent the flat leading edge contacts or brushes the grass or earth during the stroke. Because the sole of the club head is rounded and the hands are placed forward, swing drag through the grass is minimized. Therefore, the golfer is able to hit these delicate shots consistently and accurately.

The putting wedge can also be used to hit a very high lob shot when the golfer closes the wedge face by rotating the toe of the club down towards the ground before making the stroke. The club is preferably designed to allow the golfer to lob the ball up and onto the green from the rough, or a sand trap around the green. The club head has a leading apex preferably at the intersection of the wedge surface, the sole, the toe of the club head, and the blade portion (which is preferably a putting face) between the wedge face and the sole. Between the crown of the rounded sole and the leading apex, the sole consists of a spade portion which is generally triangular and slightly convex. Preferably, the angle between the wedge face and the spade portion is within the range of 30°–60°. The wedge face preferably contains parallel grooves along its face which are aligned in a direction perpendicular to which the leading apex is pointing. The grooves contact the ball during a lob shot and generate backspin when the ball is struck after the wedge face has been turned inward to close the wedge face. When used in this fashion, the club is more consistent than contemporary sand wedges because the leading apex and spade portion of the sole cut through the ground easily and quickly without providing significant resistance to the club head when taking the stroke. The club head also has less tendency to bounce when performing a lob shot in the rough or stand trap. When used in this fashion, the club is especially useful when golfers need to play the ball from a difficult lie.

The putting wedge as described herein minimizes errant shots. It should be apparent to those skilled in the art that the putting wedge described above may be helpful to allow golfers to get up and down more consistently.

DETAILED DESCRIPTION OF THE DRAWINGS

Figure 1:
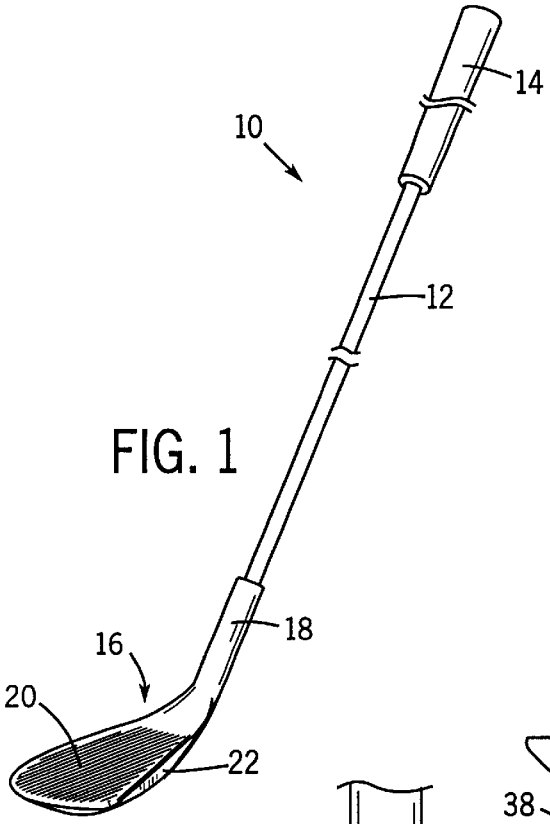
FIG. 1 is a perspective view of a golf club constructed in accordance with the preferred embodiment of the invention.

FIG. 1 shows a golf club 10 constructed in accordance with the invention. The club 10 preferably has a steel shaft 12. For most players, it will be desirable that the shaft 12 be a stiff, heavy shaft. A grip 14 is attached to a top end of the shaft 12. A club head 16 is attached to a bottom end of the shaft 12. The club head 16 includes a hosel 18 that provides a passageway for attaching the club head 16 to the bottom end of the shaft 12. The hosel 18 is connected to the shaft 12 by gluing or any other method typically used in the art.

Figure 2:
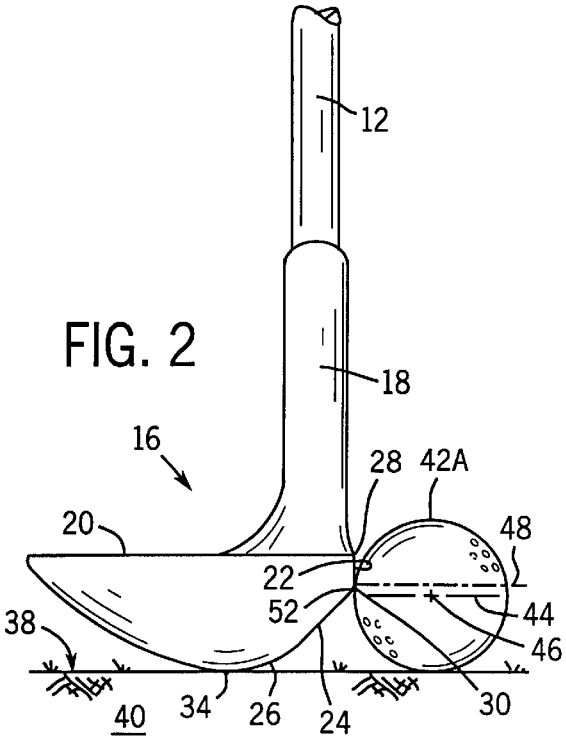
FIG. 2 is a side elevational view showing the club head shown in FIG. 1 striking a golf ball with the putting face on the club head.
Figure 3:
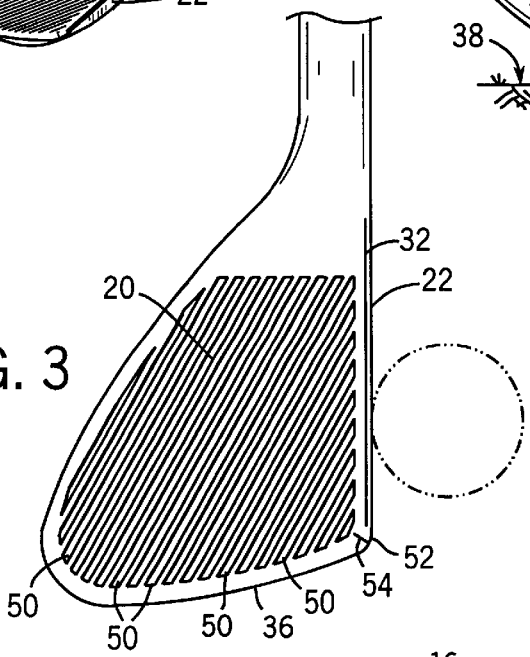
FIG. 3 is a top view of the club head of the club shown in FIG. 1.
Figure 4:
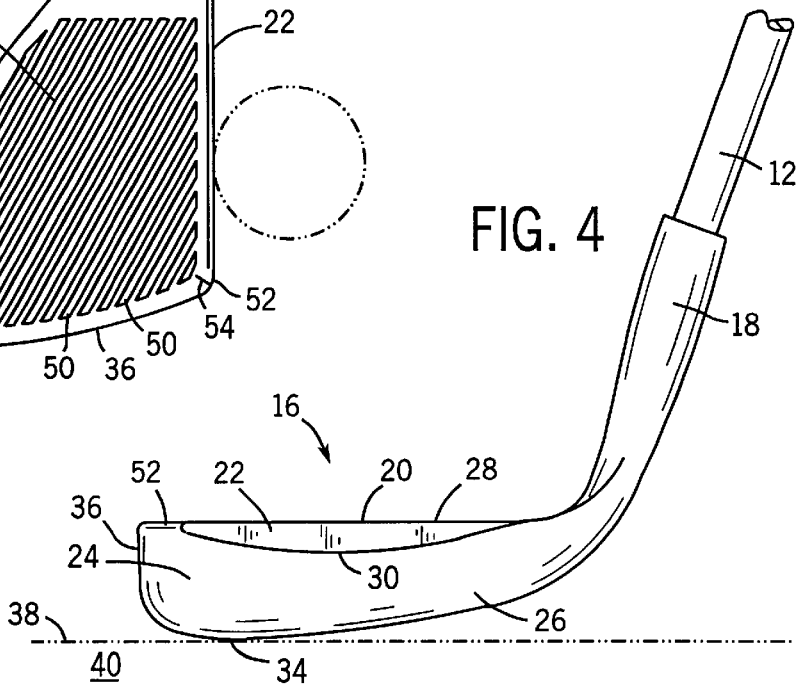
FIG. 4 is a front elevational view of the club head of the club shown in FIG. 1.

The club head 16 includes both a wedge face 20 and a putting face 22. Referring in particular to FIGS. 2–4, the putting face 22 is located along a blade area between the wedge face 20 and a front portion 24 of a rounded sole 26 of the club head 16. The loft of the putting face 22 is preferably about 0° in relation to the putting shaft 12, see FIG. 2. Conversely, the loft of the wedge face 20 in relation to the shaft 12 is greater than 70° and preferably about 90°, also see FIG. 2. If desired, the loft of the wedge face 20 may be greater than 90°. The putting face 22 is preferably a planar surface. The periphery of the putting face 22 is preferably defined by the straight line 28 defining the intersection between the wedge face 20 and the putting face 22, and an arced line 30 defining the intersection between the lower portion of the putting face 22 and the rounded sole 26 on the bottom of the club head 16. Although not shown in the drawings, the intersection between the wedge face 20 and the putting face 22 is preferably filed or beveled at a 30° to 60° angle (rather than defining a sharp right angle). An indicator line 32 is located on the wedge face 20, FIG. 3, adjacent to and parallel with the putting face 22. The purpose of the indicator line 32 is to help the golfer visualize the orientation of the putting face 22 when the golfer takes a normal putting stance and grip of the club 10. When putting, it is desired that the golfer hold the club 10 so that the wedge face 20 remain substantially parallel to the ground when the club is resting on the crown of the sole 26 (assuming that the wedge face 20 has a 90° loft).

The rounded sole 26 of the club head 16 includes a crown 34, FIGS. 2 and 4. The crown 34 is preferably located along the club head sole 26 at a location closer to the toe 36 of the club than the hosel 18. When the club 10 is used for putting, as depicted in FIGS. 2–4, the golfer takes a back swing, then during the forward swing of the putting stroke, it is intended for the crown 34 of the rounded sole 26 to slide across the surface 38 of the ground 40. The sole 26 and in particular the crown 34 are rounded to ensure that the sole 26 does not catch on the ground 40. The putting face 22, as shown in the drawings, is relatively narrow in height, and is located at a height above the crown 34 of the sole 26 such that the putting face preferably strikes the ball 42 at a height above the equator of the ball 42A. In FIG. 2, the equator of the ball 42A is depicted by reference number 44 and is shown to pass horizontally through the center 46 of the ball 42A. Line 48 extending perpendicularly from the putting face 22 through the ball 42A depicts the height at which the putting face 22 strikes the ball 42A. With the design of the club head 16 described herein, a golfer is better able to intentionally and consistently strike the golf ball 42A above the ball's equator 44 while putting in order to promote top spin during the putt earlier than with conventional putters. It is believed that top spin on the putt is also promoted because much of the weight of the club head 16 is in fact located behind the putting surface 22, and therefore also above the equator 44 of the ball 42A.

It has been found that the club 10 is particularly effective compared to conventional clubs when putting off the green or when the ball is nested against the fringe or the rough.

Figure 5:
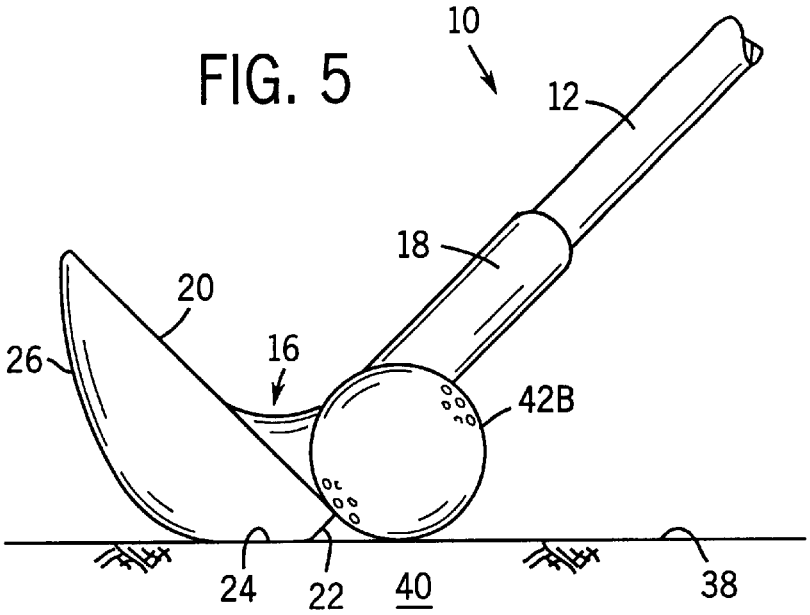
FIG. 5 is a view illustrating the use of the club shown in FIG. 1 to hit a short chip shot near the green.

Referring to FIG. 5, the club 10 can also be used to make short chips or pitch shots near the green. To do so, the golfer should place their hands well forward of the club head 16 in order to reduce the loft of the wedge face 20, see FIG. 5. When the golfer swings the club 10, the wedge face 20 will strike the ball 42B and the ball will be hit at an angle of approximately 60°, depending on the positions of the hands of the golfer when the golfer strikes the ball 42B. The rounded sole 26, and especially the front portion 24 adjacent the flat blade area 22, contacts or brushes the grass 38 or rough. Because the sole 26 of the club 10 is rounded, swing drag caused by grass 38, or rough, is minimized. The combination of placing the hands forward and the rounded reduces the chance of an unintended chunk shot. Also, it substantially reduces unintended blade shots because of the orientation of the club. The front straight edge 22 also helps the golfer maintain proper alignment while taking a short chip, as depicted in FIG. 5. It has been found that this technique is particularly useful for hitting short sand shots from relatively hard or wet sand traps.

Referring again to FIGS. 3 and 4, the wedge face 20 includes a plurality of parallel grooves 50. The grooves 50 start at a leading apex 52 that is located at the intersection of the wedge face 20, the rounded toe of the club head 16, the rounded sole 26, and the putting face 22. The wedge face 20 preferably includes a mark 54 indicating the location of the leading apex 52. As mentioned previously, the portion of the rounded sole 26 located between the crown 34 and the leading apex 52 is in the form of a generally triangular spade. The generally triangular spade portion 24 has a slight convex surface, and is preferably orientated at about a 45° angle with respect to the plane of the putting face 22 (which is preferably at a right angle from the wedge surface 20 ). The generally triangular spade surface 24 on the sole 26 of the club head 16 should be oriented generally within the range of 30°–60° from the plane in which the wedge face 20 lies if the wedge face has a 90° loft.

Figure 6:
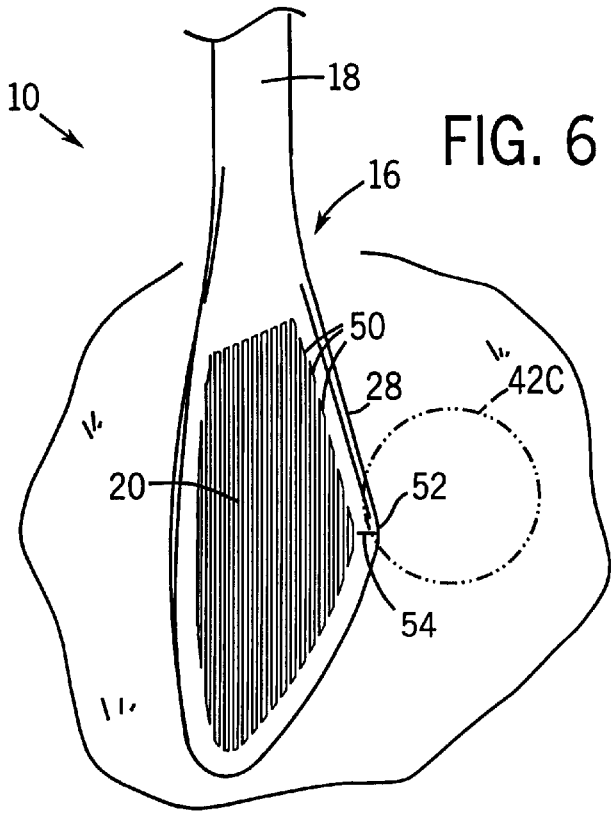
FIG. 6 is a view showing the club head of the club shown in FIG. 1 as it is used to hit a lob shot or a sand shot.

Referring to FIG. 6, the club 10 can be used to hit a high lob shot either from the fairway, the rough or a green-side sand trap by closing the wedge face 20 of the club head 16 so that the leading apex 52 points forward. The mark 54 helps the golfer align the club so that the leading apex 52 is pointing forward. The grooves 50 are perpendicular to the forward direction of the leading apex 52 indicated by the mark 54. This is different than conventional clubs in which the grooves 50 are parallel to the front edge 28 of the wedge face 20. In all other respects, the grooves are preferably the same as conventional USGA approved club face grooves. When the club 10 is used to hit a high lob shot and the wedge face 20 is closed as shown in FIG. 6, the golfer swings the club 10 so that the wedge face 20 strikes the ball 42C with the grooves 50 pointing perpendicularly to the target. The grooves 50 impart backspin on the ball 42C to help assist the golfer in stopping the ball on the green. Before and during impact, the leading apex 52 and the spade portion 24 of the sole 26 penetrate into the ground or sand easily, thereby helping to eliminate club bounce immediately prior to impact. The rounded sole 26 of the club, however, helps to prevent the club from passing too deeply into the ground or sand, and therefore helps to avoid chunk shots. It has been found that using the club 10 with the wedge face 20 closed is also quite effective for hitting balls out of bad lies where it is important to dig into the ground or sand in order to effectively strike the ball 42C.

It should be apparent to those skilled in the art that the club 10 as described herein contains several features, and that variations to the preferred embodiment disclosed herein may be made which embody only some of the features disclosed herein. For example, it may be desirable to make a wedge as described herein without providing the features enabling effective use of the club to hit high lob shots when closing the wedge face 20; or alternatively, without providing for the features enabling the club to be used as a putter. Various other combinations, and modifications or alternatives may also be apparent to those skilled. in the art. Such various alternatives and other embodiments are contemplated as being within the scope of the following claims which particularly point out and distinctly claim the subject matter regarded as the invention.

I claim:

1. A golf club for putting and chipping comprising:

a shaft;

a grip at a top end of the shaft; and a club head comprising a hosel connected to a bottom end of the shaft, a wedge face, a sole, and a putting face located along a blade area between the wedge face and a front portion of the sole, wherein the putting face is a planar surface area defined by an intersection with the wedge face along a straight line and an intersection with the sole along an arced line.

2. A golf club as recited in claim 1 wherein the wedge face has a loft greater than 70° in relation to the shaft.

3. A golf club as recited in claim 2 wherein the loft of the wedge face is substantially 90° in relation to the shaft.

4. A golf club as recited in claim 1 wherein the sole is rounded, and a crown of the rounded sole is located closer to an outer portion of the putting face adjacent a toe of the club head than an inner portion of the putting face adjacent the hosel of the club head.

5. A golf club as recited in claim 4 wherein the putting face is located at a height above the crown of the rounded sole such that the putting face strikes a conventional golf ball above the equator of the golf ball when a golfer putts the ball with the crown of the rounded sole in contact with a putting green.

6. A golf club as recited in claim 1 wherein the sole further comprises a spade portion that is immediately adjacent a leading apex formed between an outer edge of the putting face and a toe of a club head, the spade portion forming a substantially triangular, slightly convex surface on the sole of the club immediately adjacent the apex.

7. A golf club as recited in claim 6 wherein the wedge face includes an indicator mark immediately adjacent the leading apex, indicating the location of the leading apex between the putting face, the spade portion of the sole, and the toe of the club head.

8. A golf club as recited in claim 6 wherein the angle of the spade portion of the sole with respect to the wedge face is within the range of about 30°–60°.

9. A golf club for putting and chipping as recited in claim 6 wherein:

the wedge face contains grooves that extend into the wedge face and are arranged in a parallel fashion starting from the leading apex defined by the intersection of the putting face, the sole and the toe of the club head.

10. A golf club as recited in claim 1 wherein the shaft is a steel shaft.

11. A golf club as recited in claim 1 wherein an indicator line is located on the wedge face adjacent and parallel with the putting face in order to provide an indication of the direction in which the putting face is oriented.

12. A golf club comprising:

a shaft;

a grip at a top end of the shaft; and a club head comprising a hosel connected to a bottom end of the shaft, a wedge face, a rounded sole, a rounded toe, a blade area between the wedge face and a front portion of the rounded sole, and wherein:

the club head includes a leading apex defined as the intersection between the blade portion, the wedge face, the rounded sole, and the rounded toe;

the rounded sole includes a crown and a spade portion which constitutes a substantially triangular and slightly convex surface extending from the crown of the rounded sole to the apex;

the wedge face has a loft greater than 70° in relation to the shaft; and the wedge face contains grooves that extend into the wedge face and are arranged in parallel fashion starting from the leading apex and aligned perpendicular to the direction in which the leading apex is pointing.

13. A golf club as recited in claim 12 wherein the loft of the wedge face is substantially 90° in relation to the shaft.

14. A golf club as recited in claim 12 wherein the club further comprises a putting face located along the blade area between the wedge face and the front portion of the rounded sole.

15. A golf club as recited in claim 12 wherein the angle of the spade portion of the rounded sole with respect to the wedge face is generally within the range of 30°–60°.

* * * * *